US005087301A

United States Patent [19]

Angers et al.

[11] Patent Number: 5,087,301

[45] Date of Patent: Feb. 11, 1992

[54] ALLOYS FOR HIGH TEMPERATURE APPLICATIONS

[76] Inventors: Lynette M. Angers, 1120 Fox Hill Dr., #315, Monroeville, Pa. 15146; Douglas G. Konitzer, 3865 Franklintown Dr., Murrysville, Pa. 15668; Joanne L. Murray, 5744 Kentucky Ave., Pittsburgh, Pa. 15232; William G. Truckner, R.D. #1, Box 22BC, Avonmore, Pa. 15618

[21] Appl. No.: 288,635

[22] Filed: Dec. 22, 1988

[51] Int. Cl.[5] ..... C22F 1/04

[52] U.S. Cl. ..... 148/12.7 A; 148/415

[58] Field of Search ..... 148/11.5 A, 11.5 P, 148/12.7 A, 415–418, 437–440

[56] References Cited

U.S. PATENT DOCUMENTS

| | | | |
|---|---|---|---|
| 2,966,735 | 1/1961 | Towner et al. | 75/249 |
| 2,966,736 | 1/1961 | Towner et al. | 75/249 |
| 3,172,196 | 3/1965 | Beaver et al. | 75/250 |
| 4,347,076 | 8/1982 | Ray et al. | 148/11.5 A |
| 4,464,199 | 8/1984 | Hildeman et al. | 75/249 |

FOREIGN PATENT DOCUMENTS 8601050 5/1986 PCT Int'l Appl. .

OTHER PUBLICATIONS

Savage et al., "Microstructural Characterization of As-Cast Rapidly Solidified Al-Sm, Al-Gd and Al-Er Binary Alloys", Proceedings of an International Conference, S.D. Ca., Feb. 3-5, 1986.

*Primary Examiner*—R. Dean

*Attorney, Agent, or Firm*—Wegner, Cantor, Mueller & Player

[57] ABSTRACT

This invention relates to a metal alloy, comprised of two elements, a solute and a solvent, the solute having a maximum equilibrium solid solubility (at one atmosphere pressure) of less than 1 wt. -% in the solvent, the solvent and the solute dissolved therein forming a matrix phase, the matrix phase having a subgrain structure defined by subgrain boundaries and particles at intersections of the boundaries, the subgrains having an average size of less than 5 microns in diameter, and, within the subgrains a dispersion of particles which are finer than the particles at the subgrain boundaries, both types of particles being harder than the matrix phase.

16 Claims, 2 Drawing Sheets

ALLOYS FOR HIGH TEMPERATURE APPLICATIONS

BACKGROUND OF THE INVENTION

The present invention is directed to alloys having high strength at high temperatures. The invention is concerned particularly with alloys lighter than conventional high temperature alloys, such as would be useful in the aerospace field. Difficulties encountered in producing such alloys, which generally include fine particles dispersed in a matrix, involve achieving a high volume fraction of particles in the matrix and maintaining stability of the fine particles at high temperatures.

SUMMARY OF THE INVENTION

Alloys according to the present invention maintain high strength at high temperatures and are characterized by a matrix phase having a subgrain structure defined by subgrain boundaries and particles at intersections of the boundaries. Within the subgrains is a dispersion of particles which are finer than the particles at the subgrain boundaries. The matrix phase includes solvent and solute dissolved therein, with the solute preferably having a maximum equilibrium solubility in the solvent of 1 wt % or less (at 1 atmosphere pressure). An aluminum-erbium alloy is one example of the alloys of the present invention. Other suitable alloying agents for aluminum may include scandium, ytterbium, thulium and uranium. Alloy systems other than aluminum systems, such as magnesium and nickel systems, are contemplated also. The alloys can be prepared by a process including rapid solidification processing of the molten metal, which provides a cellular-type structure defined by incoherent particles, which upon further treatment results in the subgrain structure discussed above.

DETAILED DESCRIPTION OF THE INVENTION

Figure 1:
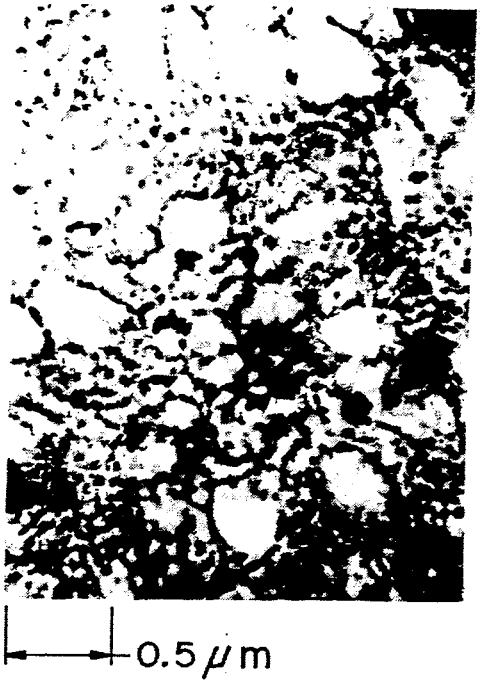
FIG. 1 shows a typical microstructure observed by transmission electron microscopy near the chill surface of the Al—29.2 Er melt spun ribbon. This microstructure may be described as microcellular.

This invention relates to the production of improved alloy products characterized by high-yield strength at elevated temperatures, e.g. up to 900° F. and therefore useful in aircraft and other important applications. For example, it is an objective in development of alloys for applications such as advanced turbofan engines to produce those which lead to an improved thrust to weight ratio. A standard means of obtaining increased thrust to weight ratio involves substituting lighter weight materials for conventional titanium alloys. Aluminum alloy systems are one possible source for alloys lighter than conventional titanium alloys. The development of aluminum alloys which are useful to higher temperatures than current aluminum alloys will provide the benefits of reduced component weight and may provide savings in material and fabrication costs as well.

One way to produce an alloy which has resistance to deformation at elevated temperatures is to introduce a high volume fraction of fine stable strengthening particles. To ensure a high volume fraction, the alloying agents should have high liquid solubilities. To ensure stability of such particles against coarsening, alloying elements with low solubilities and low solid state diffusion rates in the matrix have been traditionally chosen.

Rapid solidification processing (RSP) is required to prepare alloys with substantial volume fraction of fine dispersoids containing such elements. The high cooling rates typical of RSP processes can produce metastable phases and prevent or markedly reduce the compositional segregation in solid solutions wherein a large excess of solute element can be retained uniformly throughout the host element or alloy. The fine dispersed intermetallic particles may be produced during the RSP or be precipitated from the supersaturated solution upon subsequent heat treatment.

The superior thermal stability of coherent and partially coherent aluminum-rich intermetallic phases over the incoherent types present in the Al—Fe—X systems has been demonstrated for the Al—Zr and Al—Zr—V systems. The thermal stability has been attributed to the low interfacial energies that exist between the fcc aluminum matrix and the $L1_2$ $Al_3Zr$ and $Al_3(Zr,V)$ particles since both are cubic and have similar lattice parameters. While the lowest coarsening rates were measured in alloys where the lattice parameter mismatch and hence, the particle-matrix interfacial energy was minimized, the binary $Al_3Zr$ particles still exhibited significantly greater thermal stability than the incoherent Al—Fe—X particles at 425° C. Unfortunately, practical limitations in cooling rate restrict the supersaturation and hence the volume fraction of coherent dispersed phase which can be introduced through subsequent solid state reaction in the Al—Zr and Al—Zr—V systems.

A low energy particle-matrix interface may exist in other systems. Some of the transition metals and some of the rare earth elements form $L1_2$ $Al_3X$ phases with aluminum. Unlike the transition metal elements, which are involved in peritectic reactions at the aluminum-rich end of the phase diagram and form metastable $L1_2$ phases, the rare earth elements are involved in eutectic reactions and form stable $L1_2$ phases. The phases containing rare earth elements are further differentiated from those of the transition elements in that they have larger lattice parameters and hence larger mismatch with the aluminum matrix.

The present invention relates to a metal alloy comprising two constituents, one of which (the solute) has a maximum equilibrium solid solubility (at one atmosphere absolute pressure) of less than 1 wt.- % in the other (the solvent), the solvent and solute dissolved therein forming a matrix phase. The matrix phase has a subgrain structure defined by subgrain boundaries and particles at intersections of the boundaries, the subgrains being of an average size of less than 5 microns in diameter. Within the subgrains is found a dispersion of particles which are finer than the particles at the subgrain boundaries, both types of particles being harder than the matrix phase.

Aluminum systems of the present invention include alloys containing rare earth elements which form stable $L1_2$ phases and provide suitable dispersion of strengthening particles. The microstructure which is most desirable is that which contains the highest volume fraction of coherent particles, the finest incoherent particles and the finest cell structure. The particles and cells should also be resistant to growth at elevated temperatures. These features are exhibited by the Al—Er—X alloys, as documented by optical and transmission microscopy. Particular attention is paid to subgrain size, incoherent dispersoid size and volume fraction, and coherent dispersoid size and volume fraction. The effect of thermal exposures on these features is also examined.

An alloy with the structure as described above may be prepared by the following process steps. First, rapid solidification processing of molten metals with sufficient undercooling leads to a cellular-type structure defined by incoherent particles and a supersaturated solid solution. An example of such rapid solidification processing (RSP) is melt spinning of ribbon. Conventional powder metallurgical techniques for consolidation can be used in preparing bulk materials. Thermo-mechanical treatment of the bulk material converts the original cellular structure to a subgrain structure within a matrix phase, the subgrain structure being defined by subgrain boundaries and particles at the intersections of the boundaries. Heat treatment to precipitate fine particles within the subgrains can be carried out before or after the consolidation processing. If desired, it is contemplated that the consolidation processing would encompass the precipitation heat treatment, so that precipitation could be accomplished simultaneously with the formation of the bulk materials. Extrusion, rolling and forging are examples of thermo-mechanical treatments which would result in the deformation which produces the desired conversion to the subgrain structure discussed above. International Published Application WO 86/06748 (Applicant—Aluminum Company of America; Inventors—Roberto J. Rioja and Diana K. Denzer) includes examples of suitable consolidation and thermo-mechanical processing steps, it being recognized that appropriate adjustment of the conditions would be required, taking into account the different alloys. Moreover, it is not thought necessary to utilize the uniformizing treatment disclosed in that publication when processing chopped particles obtained by melt spinning, because the extremely rapid cooling achieved by the melt spinning process leads to particles which are completely zone A, thus overcoming the toughness problem characterizing particles containing both zone A and zone B material. The disclosure of the WO 86/06748 publication is incorporated herein by reference.

Figure 2:
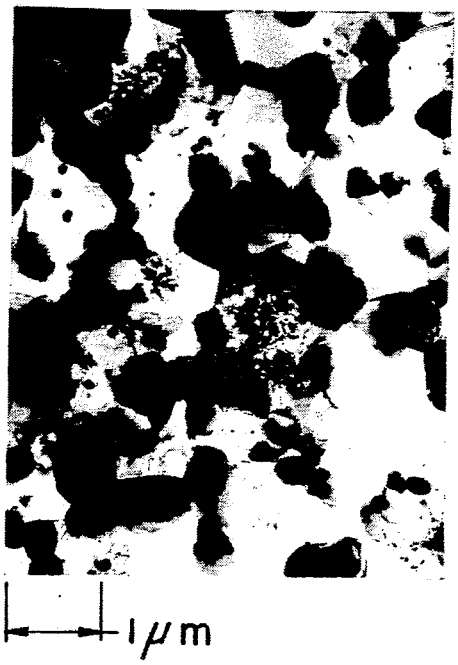
FIG. 2 shows a bright field image of ribbon aged 16 hours at 482° C., illustrating the rapid growth or spheroidization of the incoherent $Al_3Er$ particles originally at cell boundaries.

FIGS. 1 and 2 illustrate the structural changes that take place during processing. As seen in FIG. 1, a cellular-type structure with particles concentrated at the cell boundaries results after rapid solidification processing. Following heat treatment, the particles seem to spheroidize at the cell corners as seen in FIG. 2.

The aluminum-rare earth compositions of the present invention possess the desirable properties of both the nickel-base superalloys and the elevated temperature Al—Fe—Ce alloys. That is, the present alloys include coherent $L1_2$ particles analogous to the $\nu'$ particles of the nickel-base superalloys and the incoherent intermetallic particles and substructure of the Al—Fe—Ce alloys. By analogy to the nickel-base superalloys, an aluminum alloy strengthened by precipitates which are coherent and coplanar with the matrix might be expected to maintain high strength levels at temperatures as high as 75% of the melting temperature. The use temperature for aluminum alloys strengthened by coherent dispersoids, incoherent dispersoids and substructure thus would be extended beyond the range suitable for Al—Fe—Ce.

In addition to the aluminum-based alloys, magnesium and nickel based alloys, as well as other base metals, are also of interest. Magnesium would be particularly attractive for providing low density structural materials. The strong grain size effect in magnesium alloys also makes rapid solidification a very attractive means of production.

As noted above, examples of the present invention include the Al—Er systems. Examples of the composition of the alloy containing 25 vol% $Al_3Er$ as well as the melt spun ribbon thickness are Al - 29.2 wt % Er (6.25.at %) and 25–75 microns respectively. The 29.2% Er alloy will have a density of about 3.1 g/cm$^3$ and a liquidus temperature of about 1290° C. although the range for the liquidus temperature depends to a large extent on the identity of other elements in the alloy, and thus may range from 1200° C. to 1400° C. Other rare earth metals may be used as alloying agents, including Sc, Yb, Tm, and U, although their use may not be as practical as Er. Scandium would likely be too expensive to obtain for large scale operations and the other metals are heavier than erbium. The systems of the present invention may include other elements or additives in addition to the rare earth metal for purposes such as grain refining, solid solution strengthening, or density reduction. For example, Ti and B may be used for grain refining. Si or Mg may be used as solid solution strengtheners. Zr may be used to substitute for Er as a density reducing agent. One or more of these additives can be substituted for the rare earth metal alloying agents of this embodiment of the present invention and should be considered to be within the scope of the present invention to the extent they do not alter the primary behavior of the alloys.

Microstructural studies carried out as a basis for the present invention indicate that the Al—$Al_3X$ systems may offer potential for greater strength than Al—Fe—Ce. In particular, the Al—Er system, due in part to the eutectic reaction involving Al and $Al_3Er$, offers strengthening from incoherent particles and a substructure, both similar in dimensions to the Al—Fe—Ce alloys. In addition, the Al—Er system offers potential for additional strengthening by fine coherent $L1_2$ $Al_3Er$ particles precipitated by solid state reaction. Since the incoherent and coherent particles which form in the Al—Er system are chemically and structurally the equilibrium forms, the system is not subject to undesired phase transformations.

As noted previously, melt spinning is used to produce the rapidly solidified materials of the present invention. Since the volume fraction of particles produced by solid state reaction will increase with undercooling, melt spinning is preferred over gas atomization as a means of preparing materials.

In the aluminum alloy systems of the present invention, compositions corresponding to approximately 25 volume % dispersed $Al_3X$ phase are of particular interest. Lower values, such as 15 volume %, are conceivable where a large proportion of the dispersed particles are coherent. In the Al—Er system, this would correspond to about 17.4 wt % Er. Higher values are also possible, although at extremely high levels fracture toughness may be adversely affected.

Figure 3:
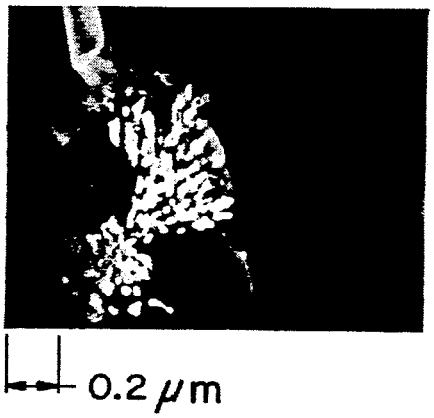
FIG. 3 shows a dark field image produced by transmission electron microscopy taken using $g=\frac{1}{2}$ (022) at the chill surface of Al—29.2 Er ribbon after aging 16 hours at 482° C. revealing non-spherical particles.

Microstructural investigation involved optical microscopy and Guinier X-ray analysis of through thickness sections and transmission electron microscopy at the ribbon chill surfaces. Foils for transmission microscopy were prepared by dimpling from the free side of the ribbon to perforation and subsequent single gun ion milling to obtain thin area at the chill surfaces. Characterization was carried out on the as melt spun ribbon as well as on material aged at least 16 hours at 262° C., 400° C. and 482° C. Fine primary $L1_2$ $Al_3Er$ particles (less than 0.1 micron) are present at the boundaries of a cellular solidification structure in the Al—Er ribbons. Optical metallography on Al—29.2Er suggests that the microstructures are unstable during aging at 400° C. and 482° C., although the $Al_3Er$ particles which precipitate through solid state reaction are considerably more stable against coarsening than those which form from the liquid. In Al—Er specimens aged at either 400° C. or 482° C., partially coherent particles having an orientation relationship with the matrix are observed. The dark field image of FIG. 3 was taken using $\vec{g}=\frac{1}{2}$ (022) and reveals non-spherical particles, despite the fact that all reflections in the zone axes patterns are consistent with cube-cube oriented $L1_2$ particles.

In comparing the Al—Zr, Al—Ti and Al—Er melt spun ribbon, it is observed that Al—Zr exhibits the greatest thermal stability. However, thermal stability is but one factor to consider. The Al—Er system provides a significant advantage over Al—Ti and Al—Zr through the higher available volume fraction of dispersed phase which may be produced by solid state reaction. This is predicted by the following thermodynamic modeling.

Figure 4A:
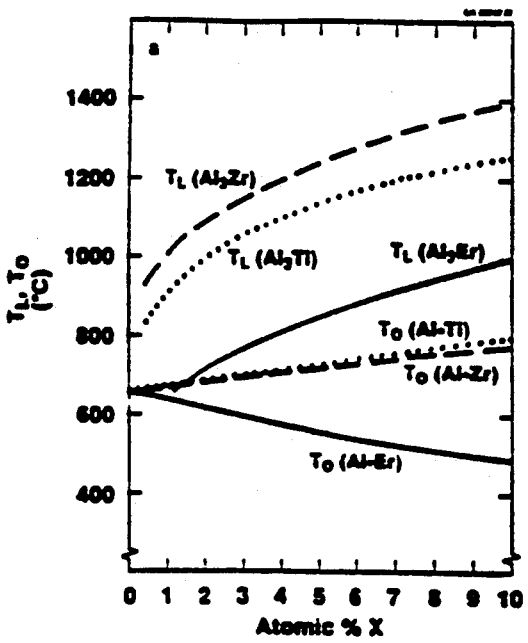
FIG. 4*a* shows the liquidus temperatures, $T_L$, of the $Al_3X$ phase and $T_O$ of the Al solid solution for the binary systems calculated from thermodynamic quantities.

Extrapolations of free energy functions to the metastable regime indicate that it should be easier to obtain a high volume fraction dispersed phase by solid state reaction in the Al—Er system than in either the Al—Zr or Al—Ti systems. Both the liquidus temperatures ($T_L$) and estimates for the temperatures for which the free energies of the liquid and solid fcc Al (ss) phases are equal ($T_O$) have been plotted in FIG. 4*a* as a function of solute content. The liquidus temperatures for the Al—Er system are significantly lower than the liquidus temperatures for the Al—Ti or Al—Zr systems. For very dilute alloys, this would imply that less undercooling is required to produce a supersaturated Al—Er solid solution than for either Al—Ti or Al—Zr systems up to very high volume fractions of dispersed phase.

Figure 4B:
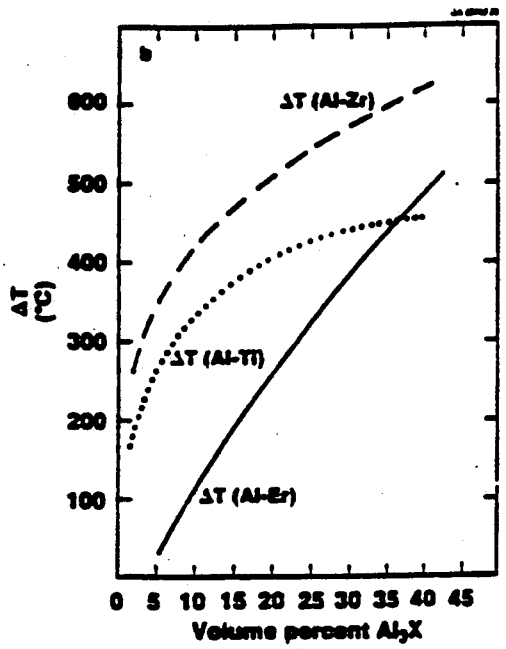
FIG. 4*b* shows the undercooling, $\Delta T$, required to produce an Al solid solution which will decompose to produce a given volume fraction $Al_3X$.

The difference $T_L-T_O$ represents the minimum undercooling thermodynamically required to solidify the single phase Al (ss); this difference, $\Delta T$, has been plotted as a function of $Al_3Er$ volume fraction which may be produced upon aging of the supersaturated solid solution in FIG. 4*b*. For solid solutions which can decompose to produce the same volume fraction of $L1_2$ phase, the Al—Zr system requires somewhat greater undercooling than the Al—Ti system. Because the effect of the lower liquidus temperatures for Al—Er is stronger than the effect of the lower $T_O$, smaller undercoolings are required for the Al—Er system than for either the Al—Ti or AL—Zr systems up to the very high volume fractions of dispersed phase. Hence, the Al—Er system may be attractive as an elevated temperature alloy despite the fact that the coherent $Al_3Er$ particles are less resistant to coarsening than the $Al_3Zr$ particles.

In summary, the Al—$Al_3Er$ system poses two advantages over the other Al—$Al_3X$ systems:

For a given undercooling, higher degrees of supersaturation can be obtained in Al—Er than Al—Ti or Al—Zr. Assuming similar solvii for these systems, higher volume fractions of the coherent $L1_2$ phase can be precipitated in Al—Er than Al—Ti or Al—Zr.

The nature of solidification in Al—Er permits the formation of a cell structure. This cell structure may define the scale of the substructure which develops during the thermochemical processing and provides a contribution to the strength of the wrought material. The fine incoherent particles which pin the substructure also provide a contribution to strength. Neither of these two strengthening components are significant in the Al—Zr or Al—Ti systems where the substructure and incoherent phases are coarser than in the Al—Er alloys.

Although a detailed description of the present invention has been provided above, the present invention is not limited thereto. Modifications will be apparent to those skilled in the art. The scope of the present invention is defined by the following claims.

We claim:

1. An alloy, comprising a solute and a solvent, the solvent and the solute dissolved therein forming a matrix phase, the matrix phase having a subgrain structure defined by subgrain boundaries and particles at intersections of the boundaries, and within the subgrains a dispersion of particles which are finer than the particles at the subgrain boundaries, the particles within the subgrains originating from a solid-solid transformation.

2. The alloy of claim 1, wherein the solute has a maximum equilibrium solid solubility (at one atmosphere pressure) of less than 1 wt.- % in the solvent.

3. The alloy of claim 2, wherein the subgrains have an average size of less than 5 microns in diameter.

4. The alloy of claim 3, wherein both types of particles are harder than the matrix phase.

5. The alloy of claim 4, wherein the alloy is represented by the formula Al—X, and X is selected from the group consisting of Er, Sc, Yb, Tm, and U.

6. The alloy of claim 5, wherein at least 15 volume percent is $Al_3X$ in the stable phase.

7. The alloy of claim 1, wherein at least 25 volume percent is $Al_3X$ in the stable phase.

8. The alloy of claim 6, wherein the stable phase is formed following rapid solidification processing and heat treatment.

9. The alloy of claim 8 having the formula Al - 29.24 wt. % Er with a density of about 3.1 g/cm$^3$ and a liquidus temperature in the range of about 1200° C. to 1400° C.

10. An alloy comprising aluminum and an alloying agent having a maximum equilibrium solid solubility (at one atmosphere pressure) of less than 1 wt.- % in the aluminum, selected from the group consisting of Er, Sc, Yb, Tm and U, the aluminum and alloying agent dissolved therein forming a matrix phase having a subgrain structure defined by subgrain boundaries and incoherent particles at the intersections of the boundaries, the subgrains being of an average particle size of less than 5 microns in diameter, and within the subgrains a dispersion of coherent and incoherent particles which are finer than the particles at the subgrain boundaries, the particles within the subgrains originating from a solid-solid transformation, and both the particles at the intersections and he particles of the dispersion being harder than the matrix phase, wherein at least 15 vol.- % of the alloy is $Al_3X$ in the stable phase.

11. A process for producing the alloy of claim 1, comprising the steps of:

a) rapid solidification of molten metals to provide a solid material having a cellular-type structure defined by incoherent particles and a supersaturated solution;

b) consolidation processing to produce a bulk material;

c) thermo-mechanical treatment of the bulk material to convert the cellular-type structure to a subgrain structure within a matrix phase, the subgrain structure being defined by subgrain boundaries and particles at the intersections of the boundaries; and d) precipitation heat treatment to produce in the subgrains a dispersion of particles which are finer than the particles at the subgrain boundaries.

12. The process of claim 11, wherein the precipitation heat treatment is carried out before the consolidation processing.

13. The process of claim 11, wherein the precipitation heat treatment is carried out after the consolidation processing.

14. The process of claim 11, wherein the consolidation processing causes the precipitation of the dispersion of particles in the subgrain.

15. The process of claim 11, wherein the thermo-mechanical treatment causes precipitation of the dispersion of particles in the subgrain.

16. The process of claim 11, wherein both types of particles of steps c) and d) are harder than the matrix phase.

* * * * *